US011564417B2

(12) United States Patent
Li et al.

(10) Patent No.: US 11,564,417 B2
(45) Date of Patent: Jan. 31, 2023

(54) HEATING ASSEMBLY, ATOMIZER AND ELECTRONIC ATOMIZING DEVICE

(71) Applicant: Shenzhen Smoore Technology Limited, Guandong (CN)

(72) Inventors: Guanghui Li, Guandong (CN); Weidong Pan, Guandong (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 847 days.

(21) Appl. No.: 16/505,531

(22) Filed: Jul. 8, 2019

(65) Prior Publication Data

US 2020/0068951 A1 Mar. 5, 2020

(30) Foreign Application Priority Data

Aug. 28, 2018 (CN) ..... 201821398994.7

(51) Int. Cl.

| | |
|---|---|
| ***A24F 47/00*** | (2020.01) |
| ***A24F 40/485*** | (2020.01) |
| ***H05B 3/18*** | (2006.01) |
| ***H05B 3/46*** | (2006.01) |
| ***A24F 40/44*** | (2020.01) |

(Continued)

(52) U.S. Cl.

CPC ..... *A24F 40/485* (2020.01); *A24F 40/44* (2020.01); *A24F 40/46* (2020.01); *H05B 3/18* (2013.01); *H05B 3/46* (2013.01); *A24F 40/10* (2020.01)

(58) Field of Classification Search

CPC ..... A24F 40/46

See application file for complete search history.

(56) References Cited

U.S. PATENT DOCUMENTS

| | | | |
|---|---|---|---|
| 2013/0068239 | A1 | 3/2013 | Youn |
| 2013/0081642 | A1 | 4/2013 | Safari |

(Continued)

FOREIGN PATENT DOCUMENTS

| | | | |
|---|---|---|---|
| CN | 104207323 | A | 12/2014 |
| CN | 204091013 | U | 1/2015 |
| CN | 204499489 | U | 7/2015 |

(Continued)

OTHER PUBLICATIONS

The European Search Report for related European Application No. 19168005.7-1006 dated Oct. 7, 2019;(7 pages).

(Continued)

*Primary Examiner* — Eric Yaary

(57) ABSTRACT

A heating assembly, an atomizer and an electronic atomizing device are disclosed. The heating assembly includes a chassis and a heating component. The chassis may include a first wall having a top surface and a bottom surface opposite to the top surface, the first wall defining an air vent extending through the bottom surface, an air entering plate being connected with the first wall and covering the air vent, the air entering plate defining at least one air entering hole communicating with the installation space and the air vent, wherein the first wall and the second wall define the installation space. A heating component may be disposed in the installation space, a length of the at least one air vent is greater than that of the air entering hole in a direction from the bottom surface to the top surface.

20 Claims, 6 Drawing Sheets

(51) Int. Cl.
*A24F 40/46* (2020.01)
*A24F 40/10* (2020.01)

(56) References Cited

U.S. PATENT DOCUMENTS

| | | | | |
|---|---|---|---|---|
| 2015/0359265 | A1 | 12/2015 | Liu | |
| 2016/0106154 | A1* | 4/2016 | Lord | A24F 40/485 392/395 |

FOREIGN PATENT DOCUMENTS

| | | | |
|---|---|---|---|
| CN | 204670379 | U | 9/2015 |
| CN | 204763426 | U | 11/2015 |
| CN | 205728077 | U | 11/2016 |
| CN | 206403207 | U | 8/2017 |
| EP | 3020292 | A1 | 5/2016 |
| EP | 3081101 | A1 | 10/2016 |
| EP | 3292775 | A1 | 3/2018 |
| WO | WO20140207719 | A1 | 12/2014 |
| WO | WO2017139963 | A1 | 8/2017 |
| WO | WO2018015712 | A1 | 1/2018 |
| WO | WO2018018599 | A1 | 2/2018 |
| WO | WO2018130068 | A1 | 7/2018 |

OTHER PUBLICATIONS

The European Search Report for related European Application No. 19187464.3-1006 dated Dec. 19, 2019;(6 pages).

The Office Action for related European Application No. 19168005.7-1004 dated Sep. 9, 2020;(4 pages).

Evaluation report of utility model patent,Chinese application No. ZL201 8213989947 dated Aug. 28, 2018;(5 pages).

The Office Action for related European Application No. 19168005.7 dated Apr. 30, 2020;(5 pages).

* cited by examiner

HEATING ASSEMBLY, ATOMIZER AND ELECTRONIC ATOMIZING DEVICE

CROSS-REFERENCE TO RELATED APPLICATIONS

The present application claims foreign priority of Chinese Patent Application No. 201821398994.7, filed on Aug. 28, 2018 in the National Intellectual Property Administration of China, the entire contents of which are hereby incorporated by reference.

TECHNICAL FIELD

The present disclosure generally relates to electronic atomizing device, and in particular to a heating assembly, an atomizer and an electronic atomizing device.

BACKGROUND

People care more and more about their health. Damage of traditional tobacco to the human body has been more and more noticed. Thus, electronic atomizing devices have been created. An electronic atomizing device has similar appearance and smell as a traditional cigarette, but usually does not contain harmful ingredients such as tar, harmful aerosol, etc. Accordingly, damage of the electronic atomizing device to the user is much less than that of the traditional cigarette. The electronic atomizing device may be used to replace the traditional cigarette.

An electronic atomizing device is usually composed of an atomizer and a battery assembly.

SUMMARY

According to an aspect of the present disclosure, a heating assembly adapted to an atomizer may include a chassis having an installation space and a heating component disposed in the installation space and configured to heat fluid to generate smoke in the installation space. The chassis may include a first wall and a second wall connected with the first wall, wherein the first wall and the second wall define the installation space. The first wall may have a top surface received in the installation space and a bottom surface opposite to the top surface and exposed outside. The first wall may define an air vent extending through the bottom surface, and an air entering plate can be connected with the first wall and cover the air vent. The air entering plate may define at least one air entering hole communicating with the installation space and the air vent. The air vent has a length greater than that of the at least one air entering hole along a direction from the bottom surface to the top surface.

According to another aspect of the present disclosure, an atomizer may include a shell and a heating assembly engaged in the shell. The shell may define a smoke outlet and a liquid cavity. The liquid cavity is capable of storing a fluid to be vaporized. The smoke outlet communicates with environment outside of the shell. The heating assembly may receive the liquid from the liquid cavity to heat and generate smoke. The heating assembly may include a chassis having an installation space communicating with the smoke outlet and a heating component disposed in the installation space and configured to heat the fluid from the liquid cavity to generate smoke. The chassis may include a first wall having a top surface and a bottom surface opposite to the top surface, and a second wall connected with the first wall. The first wall may comprise a protrusion protruding beyond a top surface of the top surface and received in the installation space. The protrusion may comprise an air entering plate protruding beyond the top surface. An air vent is defined through the first wall and surrounded by the air entering plate, and the air entering plate defines a plurality of air entering holes communicating with the installation space and the air vent. The first wall and the second wall define the installation space, wherein the air vent has a length greater than that of each of the air entering holes along a direction from the bottom surface to the top surface.

According to still another aspect of the present disclosure, an electronic atomizing device may include an atomizer and a battery assembly connected together. The atomizer may include a shell and a heating assembly engaged in the shell. The shell may define a smoke outlet and a liquid cavity, wherein the liquid cavity is capable of storing a fluid to be vaporized, and the smoke outlet communicates with environment outside of the shell. The heating assembly can be engaged in the shell, receiving the liquid from the liquid cavity to heat and generate smoke. The heating assembly may include a chassis having an installation space communicating with the smoke outlet, and a heating component disposed in the installation space and configured to heat the fluid from the liquid cavity to generate smoke. The chassis may include a first wall and a second wall, the first wall may have a top surface received in the installation space and a bottom surface opposite to the top surface and exposed outside, the first wall may define an air vent extending through the first wall, an air entering plate can be connected with the first wall and covering the air vent, and the air entering plate may define at least one air entering hole communicating with the installation space and the air vent. The second wall can be connected with the first wall, wherein the first wall and the second wall define the installation space. The air vent has a length greater than that of the at least one air entering hole along a direction from the bottom surface to the top surface.

BRIEF DESCRIPTION OF THE DRAWINGS

In order to clearly explain the technical solutions in the embodiments of the present disclosure, the drawings used in the description of the embodiments will be briefly described below. Obviously, the drawings in the following description are merely some embodiments of the present disclosure. For those of ordinary skill in the art, other drawings may also be obtained based on these drawings without any creative work.

DETAILED DESCRIPTION

The disclosure will now be described in detail with reference to the accompanying drawings and examples. Apparently, the described embodiments are only a part of the embodiments of the present disclosure, not all of the embodiments. All other embodiments obtained by a person of ordinary skill in the art based on the embodiments of the present invention without creative efforts shall fall within the protection scope of the present invention.

Figure 1:
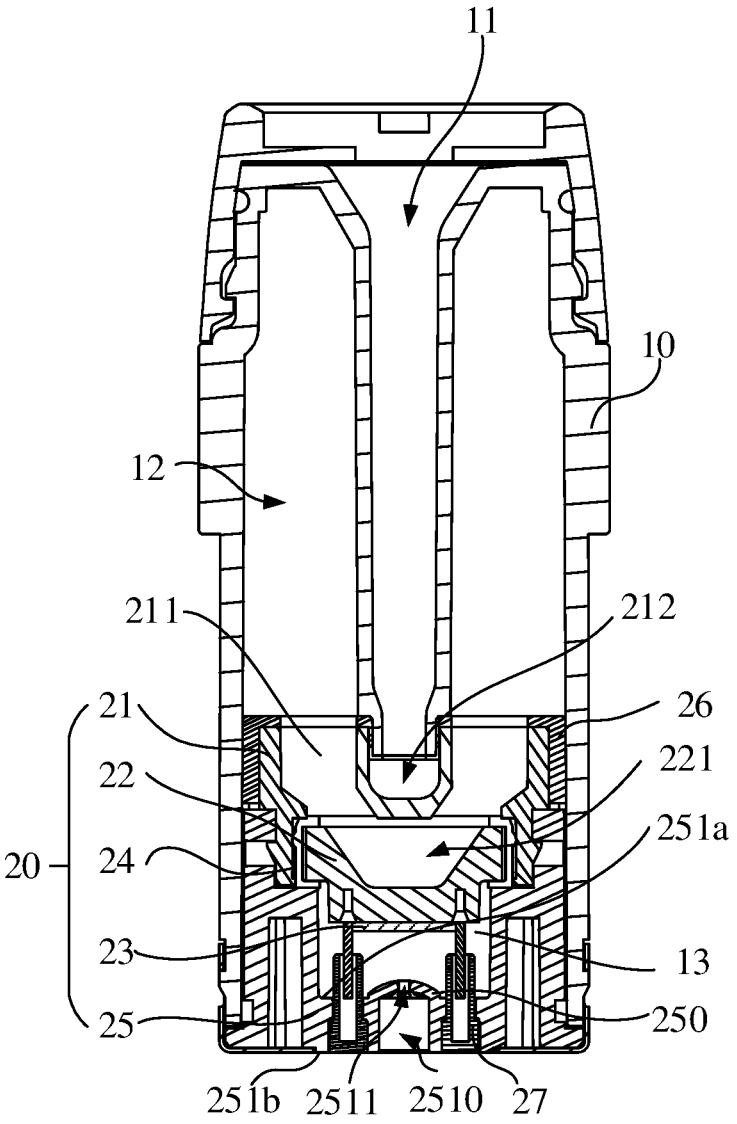
FIG. 1 shows a cross-sectional view illustrating the inner structure of an atomizer according to an embodiment of the present disclosure.
Figure 2:
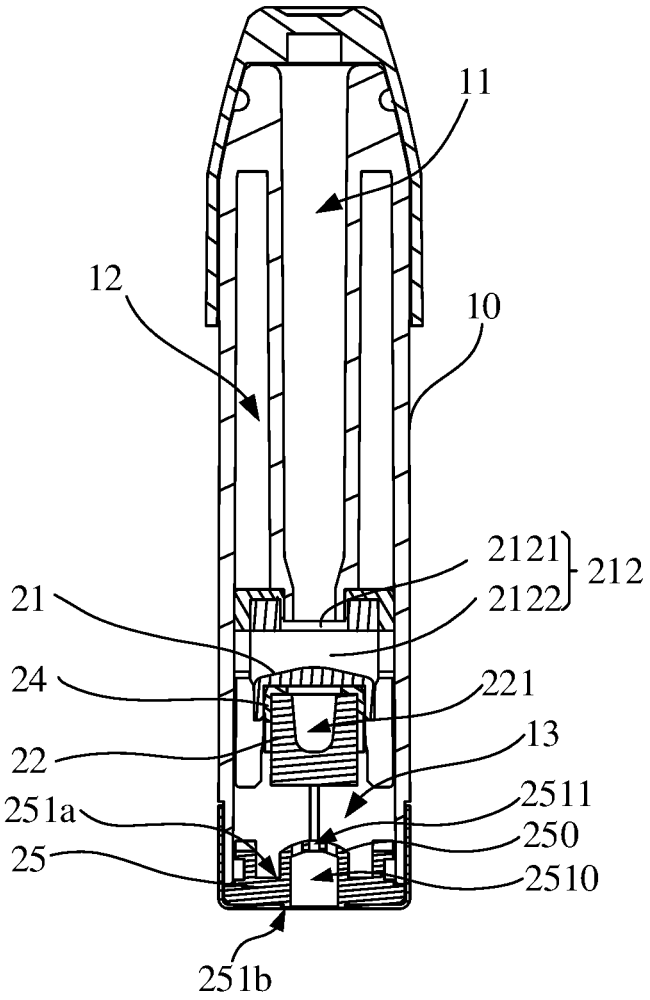
FIG. 2 shows another cross-sectional view illustrating the inner structure of the atomizer of FIG. 1 taken from another direction.

FIGS. 1 and 2 show the inner structure of an atomizer according to an embodiment of the present disclosure. The atomizer may include a shell 10 and a heating assembly 20.

The shell 10 may define a smoke outlet 11, a liquid cavity 12 and an atomizing chamber 13 separated from each other. The liquid cavity 12 may be capable of storing a fluid to be vaporized, e.g., liquid smoke. The smoke outlet 11 may communicate with environment outside of the shell 10, such that a user of the atomizer may suck the smoke generated inside the shell 10 through the smoke outlet 11.

The heating assembly 20 may be located inside the shell 10. The heating assembly 20 may separate the smoke outlet 11 and the liquid cavity 12 from the atomizing chamber 13. The heating assembly 20 may include a cover 21, a liquid guiding member 22 and a heating component 23.

Figure 3:
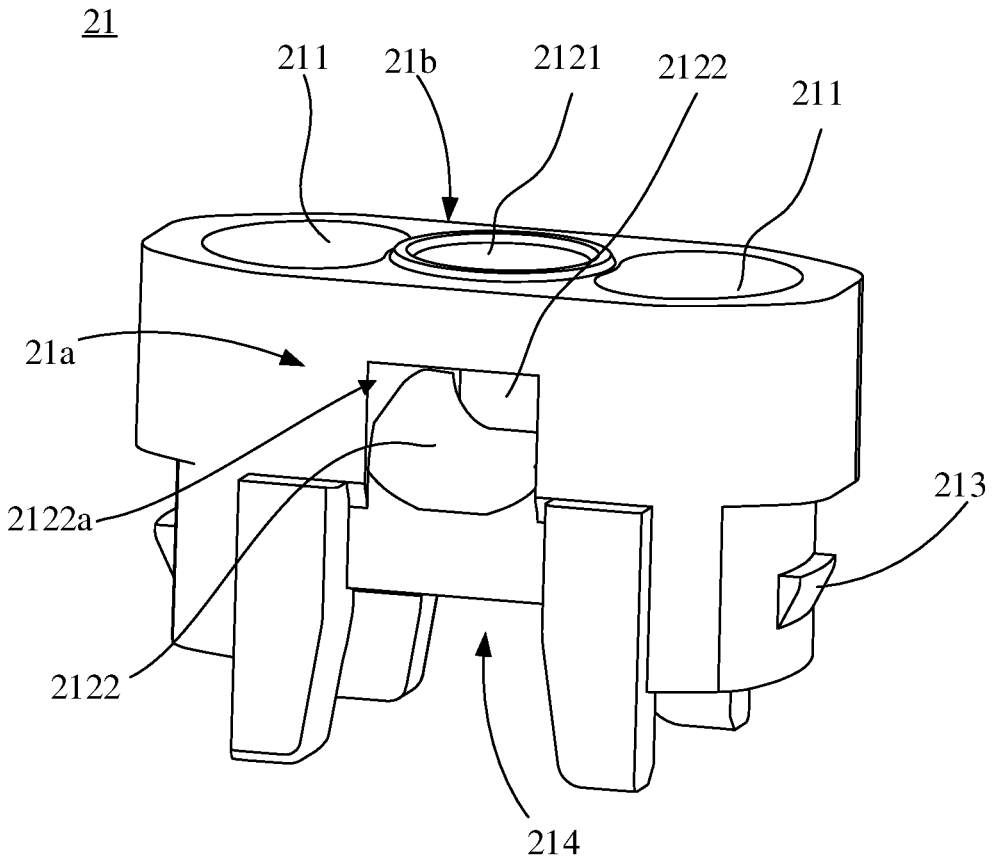
FIG. 3 is a perspective view of a cover of an atomizer according to an embodiment of the present disclosure.

Referring also to FIG. 3, the cover 21 may be an integral structure. That is, the cover 21 may be a single piece. It may define a liquid tunnel 211 and a smoke tunnel 212. The liquid tunnel 211 may communicate with the liquid cavity 12 and extend to the liquid guiding member 22. It should be understood by those of ordinary skill in the art, that although two liquid tunnels 211 and one smoke tunnel 212 are illustrated in the figures, the number of the liquid tunnel 211 and the smoke tunnel 212 is not limited. For example, the number of the liquid tunnel 211 may be one, two, three or more. By setting multiple liquid tunnels 211, fluid from the liquid tunnels 211 may be more evenly distributed on the surface of the liquid guiding member 22, thereby avoiding overheat in a certain portion of the liquid guiding member 22. The smoke outlet 11 may communicate with the atomizing chamber 13 via the smoke tunnel 212. In some embodiments, the cross-section of the liquid tunnel 211 may have a non-circular configuration. For example, the cross-section of the liquid tunnel 211 may be elliptical, rectangular, triangular or have an irregular shape. In this way, the liquid film which may block the liquid tunnel 211 is not likely to occur.

The liquid guiding member 22 may be configured to transport the fluid from the liquid tunnel 211 to the atomizing chamber 13, and to heat the fluid to generate smoke in the atomizing chamber 13. The fluid from the liquid cavity 12 may pass through the liquid tunnel 211 and penetrate the liquid guiding member 22 under capillary action. During the penetration of the liquid guiding member 22, the fluid may be heated by the heating component 23 and/or the liquid guiding member 22 (since the liquid guiding member 22 is heated by the heating component 23) and be vaporized into smoke. Thus, smoke can be generated in the atomizing chamber 13.

Figure 4:
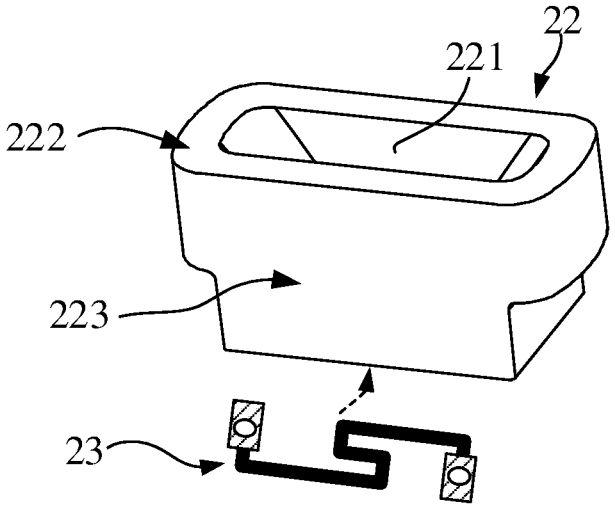
FIG. 4 is a perspective view of a liquid guiding member of an atomizer according to an embodiment of the present disclosure.

The heating component 23 may be connected with the liquid guiding member 22. For example, the heating component 23 may be connected to a side of the liquid guiding member 22 facing the atomizing chamber 13, so that the liquid can be heated into the smoke in the atomizing chamber 13 as shown in FIGS. 1 and 4. It may be utilized to heat the liquid guiding member 22 when powered. The heating component 23 may be a heating coating, a heating circuitry, a heating plate or any other suitable heating structure, which is not limited in the present disclosure.

According to the present disclosure, fluid stored in the liquid cavity 12 may arrive at the liquid guiding member 22 through the liquid tunnel 211. Then the fluid may penetrate the liquid guiding member 22 and be vaporized by the heating component 23 and/or the liquid guiding member 22 to generate smoke in the atomizing chamber 13. The smoke may then exit from the smoke tunnel 212 and the smoke outlet 11 which are interconnected together with the atomizing chamber 13 when a user uses the atomizer. The cover 21 of the atomizer is an integral structure, which may improve the sealing of the device and facilitate the installation of the device. The liquid tunnel 211 and the smoke tunnel 212 are both defined in the cover 21, which may make the inner structure of the atomizer more impact.

The liquid guiding member 22 may be a porous body, a liquid guiding rope, a guiding tube without a hole, and the like. In some embodiments, material of the liquid guiding member 22 may include porous ceramic. A porous ceramic liquid guiding member 22 may generally be formed by using sintering process with aggregate, binder and pore-forming material. Porous ceramic is now used for a wide variety of industrial applications from filtration, absorption, catalysts, and catalyst supports to lightweight structural components. A lot of pores interconnected with each other exist in the porous ceramic such that the liquid guiding member 22 made of porous ceramic may be capable of transporting the fluid (or smoke) from one of its surfaces to another. In some embodiments, the liquid tunnel 211 may extend to a first surface 222 (show in FIG. 4) of the liquid guiding member 22, and a second surface 223 (shown in FIG. 4) of the liquid guiding member 22 may be at least partially exposed in the atomizing chamber 13. Thus, the liquid guiding member may be capable of transporting the fluid arriving at the first surface 222 to the second surface 223 and the atomizing chamber 13. Specifically, the heating component 23 can be formed on a surface of the liquid guiding member 22 opposite to the first surface 223 (shown in FIG. 4).

As shown in FIGS. 1, 2 and 4, in some embodiments, the liquid guiding member 22 may define a groove 221 through the first surface 222 of the liquid guiding member 22. That is, the groove 221 may be defined at a side of the liquid guiding member 22 which is close to the liquid tunnel 211. The groove 221 may be interconnected with the liquid tunnel 211. Optionally, the size of the groove 221 may gradually decrease along the thickness direction of the liquid guiding member 22 as shown in FIG. 1. When fluid from the liquid cavity 12 arrives at the liquid guiding member 22, the fluid may be temporarily stored in the groove 221. Thus, the contact area between the fluid and the liquid guiding member 22 may be increased, thereby increasing the diffusion speed of the fluid in the liquid guiding member 22. Furthermore, the implementation of the groove 221 may reduce the overall thickness of the liquid guiding member 22, thus reducing the flow resistance of the liquid guiding member 22.

In some embodiments, the cover 21 may cover the first surface 222 and one portion of the second surface 223 of the liquid guiding member 22. In this situation, another portion of the second surface 223 of the liquid guiding member 22 may be exposed in the atomizing chamber 13, as shown in FIG. 2. Specifically, the cover 21 may define an accommodating space 214 (as shown in FIG. 3) the opening of which faces towards the liquid guiding member 22. The liquid guiding member 22 may be partially received in the accommodating space 214. In this circumstance, a portion of the second surface 223 of the liquid guiding member 22 is covered by the side wall of the cover 21 while another portion is not. Fluid from the liquid cavity 12 (or smoke generated inside the liquid guiding member 22) may exit from the uncovered portion of the second surface 223.

Figure 6:
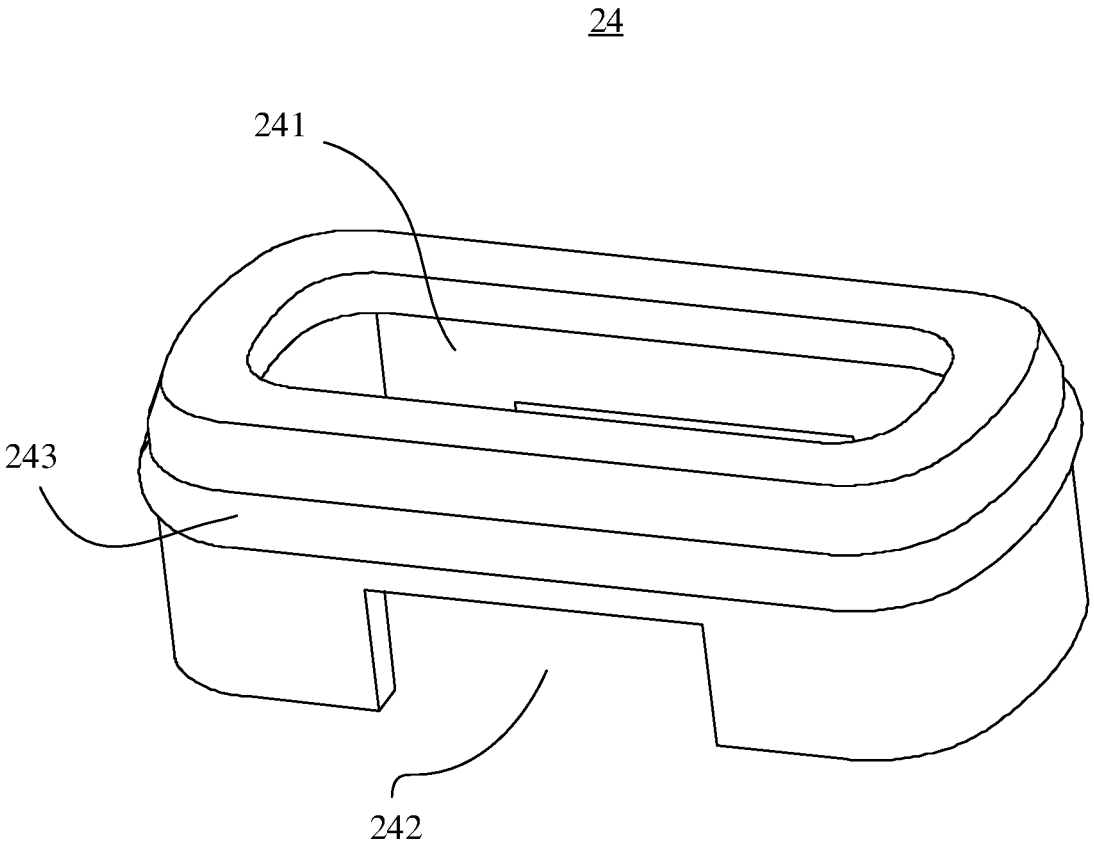
FIG. 6 is a perspective view of a sealing component of an atomizer according to an embodiment of the present disclosure.

In some embodiments, the heating assembly 20 may further include a sealing component 24, as shown in FIGS. 1, 2 and 6. The sealing component 24 may be engaged between the cover 21 and the liquid guiding member 22. The sealing component 24 may define a through hole 241 extending from the liquid tunnel 21 to the first surface 222 of the liquid guiding member 22 such that the liquid tunnel 21 may still be interconnected with the first surface 222 of the liquid guiding member 22. The size and shape of the through hole 241 may correspond to those of the liquid tunnel 21 or the groove 221. Optionally, the sealing component 24 may be made of silicone. Since silicone may have high absorbability, high heat stability, steady chemical performance and high mechanical strength, the usage of silicone may make sure that the cover 21 and the liquid guiding member 22 are well sealed. The implementation of the sealing component 24 may prevent leakage between the cover 21 and the liquid guiding member 22. Specifically, the sealing component 24 may prevent fluid from entering the atomizing chamber 13 without passing through the liquid guiding member 22, and prevent smoke in the atomizing chamber 13 from coming back into the liquid tunnel 211 and the liquid cavity 12.

In some embodiments, the first surface 222 may be the top surface of the liquid guiding member 22, and the second surface 223 may be a side surface adjacent to the top surface of the liquid guiding member 22. In this embodiment, the heating component 23 may be arranged on the bottom surface adjacent to the side surface (and opposite to the top surface) of the liquid guiding member 22.

Referring to FIGS. 2 and 3, in some embodiments, the smoke tunnel 212 of the cover 21 may be divided into a first sub-tunnel 2121 and a second sub-tunnel 2122. The first sub-tunnel 2121 may be opened from the upper surface of the cover 21, and communicate with the smoke outlet 11. The second sub-tunnel 2122 may be opened from the side surface of the cover 21, and further communicate with the atomizing chamber 13. The generated smoke may be allowed to enter the smoke tunnel 212 from the second sub-tunnel 2122, and further exit from the first sub-tunnel 2121. In some embodiments, the extending direction of the first sub-tunnel 2121 may be substantially same as the extending direction of the smoke outlet 11, and the extending direction of the second sub-tunnel 2122 may be different from the extending direction of the first sub-tunnel 2121.

As further shown in FIG. 3, the cover 21 may further include a first side surface 21*a* and a second side surface 21*b* opposite to the first side surface 21*a*. The second sub-tunnel 2122 may extend through the cover 21 from the first side surface 21*a* to the second side surface 21*b*. Further, in some embodiments, as shown in FIG. 3, the cover 21 may further include four inner walls 2122*a* connected end to end such that the second sub-tunnel 2122 may be formed or surrounded by these four inner walls 2122*a*.

Optionally, the extending direction of the second sub-tunnel 2122 may be substantially perpendicular to the extending direction of the first sub-tunnel 2121. In other words, the smoke tunnel 212 may be opened from the upper surface of the cover 21, and further extend through the first side surface 21*a* of the cover 21 and the second side surface 21*b*. The gap between the side surface of the cover 21 and the inner surface of the shell 10 may form part of the atomizing chamber 13. Since the extending directions of the first and second sub-tunnels 2121 and 2122 are not the same, the speed and the temperature of the smoke may be reduced in the smoke tunnel 212. Thus, the smoke exiting from the smoke outlet 11 and sucked by the user of the atomizer may be reduced to a proper temperature.

Figure 5:
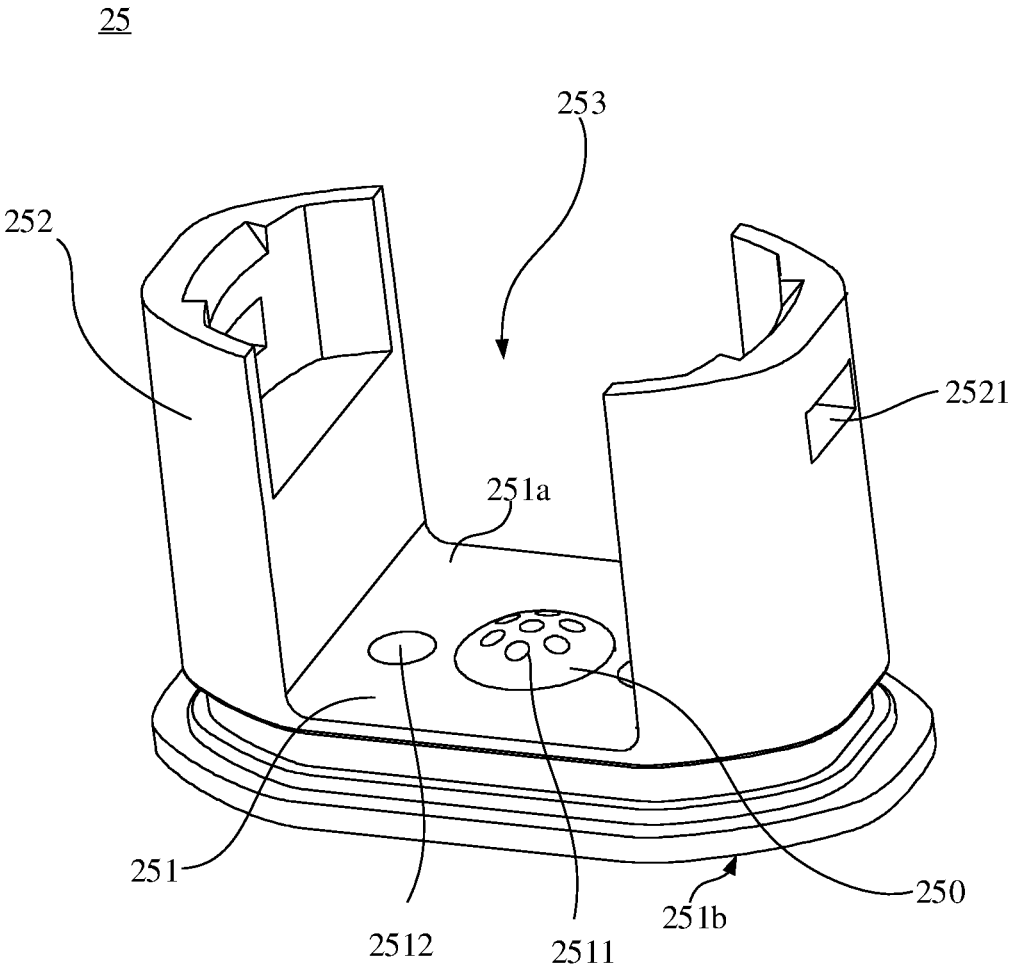
FIG. 5 is a perspective view of a chassis of an atomizer according to an embodiment of the present disclosure.

Referring to FIGS. 1, 2 and 5, in some embodiment, the heating assembly 20 may further include a chassis 25. The chassis 25 may be engaged inside the shell 10, and located at one side of the liquid guiding member 22 opposite to the first surface 222. The chassis 25 may be utilized to support the liquid guiding member 22 and the cover 21. For example, the chassis 25 and the cover 21 may both be engaged in the shell, and may cooperatively fix the liquid guiding member 22 therebetween. Thus, the heating assembly 20 is not allowed to move with respect to the shell 10.

In some embodiments, the chassis 25 may include a bottom wall 251 and a side wall 252 connected together. In some embodiments, the bottom wall 251 can be configured to be a first wall of the chassis 25, and the side wall 252 can be configured to be a second wall of the chassis 25. The side wall 252 and the bottom wall 251 may cooperatively define an installation space 253 for receiving part of the liquid guiding member 22 and part of the cover 21. The bottom wall 251 can include a top surface 251*a* received in the installation space 253 and a bottom surface 251*b* opposite to the top surface 251*a*.

In other words, when the cover 21, the liquid guiding member 22 and the chassis 25 are assembled, part of the cover 21 and part of the liquid guiding member 22 may be located in the installation space 253 defined in the chassis 25. In this circumstance, a portion of the installation space 253 is not occupied, and this portion of the installation space 253 between the chassis 25 and cover 21 can be also part of the atomizing chamber 13 inside the shell 10. Optionally, the side wall 252 of the chassis 25 and the cover 21 may be connected by clamping. Specifically, a slot 2521 may be defined in the side wall 252 of the chassis 25, and a clip 213 corresponding to the slot 2521 may be formed on the outer surface of the cover 21. The clip 213 matches the slot 2521 such that the cover 21 may be fixed with the chassis 25. It should be understood, the chassis 25 and the cover 21 may be assembled in other ways in different embodiments.

In some embodiments, the bottom wall 251 of the chassis 25 may define an air vent 2510 penetrating the bottom wall 251. The chassis 25 may include an air entering plate 250 disposed in the installation space 253 and covering the air vent 2510. The air entering plate 250 may define at least one air entering hole 2511 extending therethrough. The air vent 2510 may communicate with the installation space 253 through the air entering hole 2511. In other words, the air entering hole 2511 may communicate with the atomizing chamber 13 and the air vent 2510. In some embodiments, the air vent 2510 may be configured to guide air from outside of the chassis 25 through the at least one air entering hole 2511 into the atomizing chamber 13. At the same time, the other end of the air entering hole 2511 may be interconnected with an air pipe (not shown). For example, the air pipe may have an opening formed in the side wall, top wall or bottom wall of the vaporization device. Air entering from the air vent 2510 may be mixed with smoke in the atomizing chamber 13, and flow to the smoke outlet 11. By properly adjusting the size and shape of the air pipe and the air entering hole

2511, the ratio of the smoke to the air in the mixture generated may be controlled. Those of ordinary skill in the art should understand, the air entering hole and the air pipe may adopt any suitable arrangement, which is not limited in the present disclosure. For example, as shown in FIG. 5, there may be set six air entering holes which are radially arranged. In other embodiments, the air vent 2510 can be defined in the side wall 252.

In some embodiments, a length of the air vent 2510 can be greater than that of the air entering hole 2511 in a direction from the bottom surface 251*b* to the top surface 251*a* of the bottom wall 251. In other words, a thickness of the air entering plate 250 can be less than a thickness of the bottom wall 251. In some embodiments, a diameter of the air vent 2510 can be greater than that of the air entering hole 2511. In other words, a cross-sectional area of the air vent 2510 may be greater than sum of cross-sectional areas of the air entering hole(s) 2511. Since the length of the air vent 2510 can be greater than that of the air entering hole 2511, and the least one air entering hole 2511 may be defined in the air entering plate 250, the air entering hole 2511 may be shorter than the air vent 2510, surface tension of the liquid in the air entering hole 2511 (if exists) can be broken, and the air entering hole 2511 is not easily blocked, so that the air from outside of the chassis 25 can smoothly enter the atomizing chamber 13 through the air vent 2510 and the air entering hole 2511.

In some embodiments, as shown in FIGS. 1 and 2, the air entering plate 250 can protrude beyond the top surface 251*a* and received in the installation space 253. A projection region of the air entering plate 250 on the top surface 251*a* can be overlapped with a projection region of the air vent 2510 on the top surface 251*a*, and an area of the projection region of the air entering plate 250 can be greater than an area of the projection region of the air vent 2510. In some embodiment, the outer circumference of the air entering plate 250 can be connected to top surface 251*a* of the bottom wall 251 (as shown in FIGS. 1 and 2). In some embodiments, the outer circumference of the air entering plate 250 can be directly in contact with the top surface 251*a* of the bottom wall 251, as shown in FIGS. 1 and 5. In other embodiments, the outer circumference of the air entering plate 250 is not in contact with the top surface 251*a* of the bottom wall 251, and a circumferential wall is disposed to connect with the outer circumference of the air entering plate 250 and the top surface 251*a* as shown FIG. 2.

In some embodiments the air entering plate 250 can be located between the top surface 251*a* and the bottom surface 251*b*, and communicates with the air vent 2510 and the installation space 253. The projection region of the air entering plate 250 on the top surface 251*a* can be overlapped with the projection region of the air vent 2510 on the top surface 251*a*, an area of the projection region of the air entering plate 250 can be equal to an area of the projection region of the air vent 2510.

In some embodiments, the air entering plate 250 can be arced and may have a curved surface. As shown in FIGS. 1, 2 and 5, a center region of the air entering plate 250 may be higher than any other point of the air entering plate 250 along a direction from the bottom wall 251 to the heating component 23. In other words, a distance between a center portion of the air entering plate 250 and the bottom surface 251*b* can be higher than a distance between any other point along a direction from the bottom surface 251*b* to the top surface 251*a*.

In some embodiments, the arced air entering plate 250 may have center of circle, and a central angle of the arced air entering 250 as shown in FIG. 1 may be less than 180°, a distance from the center to the free end may be greater than a distance from the center to a wall surface of the air vent 2510. The circumferential wall as shown in FIG. 2 may extend from the free end of the air entering plate 250 and be connected with the wall surface at the top surface 251*a*.

In some embodiments, the air entering plate 250 may have a uniform thickness which is range of 0.5 mm to 1 mm. In some embodiments, the diameter of the air entering hole(s) 2511 may be less than or equal to 0.2 mm. Experiments show that as long as the diameter of the air entering hole 2511 does not exceed 0.2 mm, fluid (if exists) leaking into the atomizing chamber 13 or formed by the condensation of smoke is unlikely to block the air entering hole 2511. Thus, the reliability of the atomizer may be improved.

In some embodiments, the bottom wall 251 may further define an installation hole 2512. The installation hole 2512 may be utilized for the installation of an electrode. The electrode may be utilized to connect the heating component 23 with an external battery.

Figure 7:
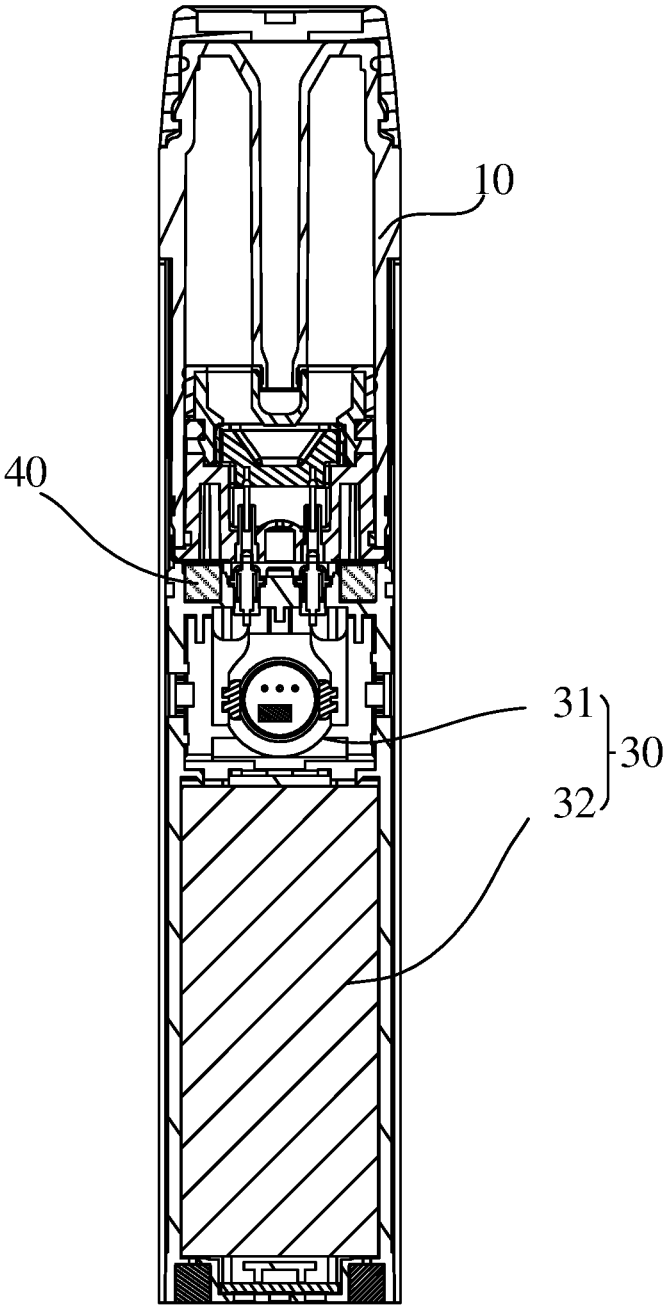
FIG. 7 is a cross-sectional view illustrating the inner structure of an electronic atomizing device according to an embodiment of the present disclosure.

Referring to FIG. 7, the atomizer may further include a battery assembly 30. The battery assembly 30 may be disposed at and connected to one end of the shell 10 close to the heating component 23. The battery assembly 30 may be utilized to provide power to the heating component 23. Thus, the heating component 23 is capable of heating the liquid guiding member 22 when necessary.

In some embodiments, the shell 10 and the battery assembly 30 may be connected together by a magnet 40 disposed therebetween. The magnet 40 may connect the battery assembly 30 and the shell 10 with magnetic force.

As shown in FIG. 7, the battery assembly 30 may include a battery 32 and an air flow controller 31. The battery 32 may be utilized for powering the heating component 23 in the shell 10. The air flow controller 31 may be set in the path between the air entering hole 2511 and the outside environment. It is utilized to open the air flow path when the user uses the atomizer, and to close the air flow path when the user does not. Specifically, when a pressure drop is detected by the air flow controller 31, the air flow controller 31 may determine that the user is using the atomizer and may accordingly open the air flow path. Thus, air may enter into the atomizing chamber 13, be mixed with smoke and be provided to the user.

In another aspect, the present disclosure further provides an electronic atomizing device. The electronic atomizing device may include the atomizer of any embodiment described above. In operation, liquid smoke may be put in the liquid cavity 12. When a user uses the electronic atomizing device, the liquid smoke may pass through the liquid tunnel 211 and arrive at the liquid guiding member 22, and then penetrate the liquid guiding member 22 under capillary action. During this process, the liquid smoke may be heated by the liquid guiding member 22 and the heating component 23 such that smoke may be generated in the atomizing chamber 13. The smoke in the atomizing chamber 13 may exit from the smoke tunnel 212 and the smoke outlet 11 interconnected with the atomizing chamber 13, and then be provided to the user. For simplicity and brevity, the structure of the electronic atomizing device will not be repeated herein.

It should be understood, the structure of the atomizer (or the electronic atomizing device) is not limited in the above-described embodiments. The atomizer may further include other components. For example, as shown in FIG. 1, the heating assembly 20 of the atomizer may further include a second sealing component 26 disposed in the gap between the cover 21 and the inner surface of the shell 10. The second sealing component 26 may be utilized to help the fixation of the cover 21 in the shell, and also to prevent fluid in the liquid cavity 12 from leaking into the lower part of the atomizer. Furthermore, the heating assembly 20 of the atomizer may also include an electrode 27 connected with the heating component 23 and extending to the outer surface (the bottom surface as shown in FIG. 1) of the shell 10. In this circumstance, when the shell 10 is connected with the battery assembly 30, the electrode 27 may be in contact with the electrode of the battery in the battery assembly 30. Thus, the battery assembly 30 may provide energy to the heating component 23 via the electrode 27.

The foregoing is merely embodiments of the present disclosure, and is not intended to limit the scope of the disclosure. Any transformation of equivalent structure or equivalent process which uses the specification and the accompanying drawings of the present disclosure, or directly or indirectly application in other related technical fields, are likewise included within the scope of the protection of the present disclosure.

What is claimed is:

1. A heating assembly adapted to an atomizer, comprising:

a chassis having an installation space and comprising:

a first wall having a top surface received in the installation space and a bottom surface opposite to the top surface and exposed outside, the first wall being a bottom wall of the chassis, the first wall defining an air vent extending through the bottom surface, an air entering plate being connected with the first wall and covering the air vent, the air entering plate defining at least one air entering hole communicating with the installation space and the air vent; and a second wall connected and integrated with the first wall, the second wall being a side wall of the chassis, wherein the first wall and the second wall cooperatively define the installation space; and a heating component disposed in the installation space and configured to heat fluid to generate smoke in the installation space;

wherein the air vent has a length greater than that of the at least one air entering hole along a direction from the bottom surface to the top surface.

2. The heating assembly of claim 1, wherein the air vent has a diameter greater than that of the at least one air entering hole.

3. The heating assembly of claim 2, wherein the air entering plate has a first projection region on the top surface, the air vent has a second projection region on the top surface, the first projection region is overlapped with the second projection region, and an area of the first projection region is greater than or equal to an area of the second projection region.

4. The heating assembly of claim 3, wherein the air entering plate is arced, and a distance between a center portion of the air entering plate and the bottom surface is greater than a distance between any other point of the air entering plate and the bottom surface.

5. The heating assembly of claim 4, wherein the air entering plate protrudes beyond the top surface and is received in the installation space.

6. The heating assembly of claim 5, wherein a free end of the air entering plate is connected with the top surface, the arced air entering plate has a center of a circle, and a distance from the center to the free end is greater than a distance from the center to a wall surface defining the air vent.

7. The heating assembly of claim 6, wherein a circumferential wall extends from the free end of the air entering plate and is connected with the wall surface at the top surface.

8. The heating assembly of claim 3, wherein the air entering plate is located between the top surface and the bottom surface.

9. The heating assembly of claim 1, wherein the at least one air entering hole comprises two or more air entering holes spaced in interval in the air entering plate, a diameter of each of the air entering holes is less than or equal to 0.2 mm; the air entering plate has a uniform thickness which is in a range of 0.5 mm-1 mm, and a thickness of the air entering plate is less than that of the first wall.

10. The heating assembly of claim 1, further comprising:

a liquid guiding member connected with the heating component and heated by the heating component; and a cover engaged with the chassis, wherein the cover is an integral structure defining a liquid tunnel and a smoke tunnel, the liquid guiding member is disposed in the installation space between the cover and the chassis, the liquid tunnel extends to the liquid guiding member, the smoke tunnel is communicating with the installation space between the cover and the chassis;

wherein the liquid guiding member is configured to transport the fluid from the liquid tunnel to the heating component, and to heat the fluid to generate smoke in the installation space between the cover and the chassis.

11. The heating assembly of claim 10, wherein a material of the liquid guiding member comprises porous ceramic;

the liquid tunnel extends to a first surface of the liquid guiding member, and a second surface of the liquid guiding member is at least partially exposed in the installation space between the cover and the chassis; and the liquid guiding member defines a groove through the first surface of the liquid guiding member, and the groove is interconnected with the liquid tunnel, wherein a cross-section of the liquid tunnel has a non-circular configuration.

12. The heating assembly of claim 11, wherein the cover covers the first surface and one portion of the second surface of the liquid guiding member, another portion of the second surface of the liquid guiding member is exposed in the installation space between the cover and the chassis.

13. The heating assembly of claim 10, wherein the smoke tunnel of the cover is divided into a first sub-tunnel opened from an upper surface of the cover and a second sub-tunnel opened from a side surface of the cover, the first sub-tunnel communicates with the smoke outlet, the second sub-tunnel communicates with the installation space between the cover and the chassis, such that the generated smoke is allowed to enter the smoke tunnel from the second sub-tunnel, and further exit from the first sub-tunnel.

14. The heating assembly of claim 13, wherein the cover comprises a first side surface and a second side surface opposite to the first side surface, and further comprises four inner walls connected end to end and forming the second sub-tunnel; the second sub-tunnel extends through the cover from the first side surface to the second side surface.

15. The heating assembly of claim 13, wherein an extending direction of the second sub-tunnel is substantially perpendicular to the extending direction of the first sub-tunnel.

16. An atomizer, comprising:

a shell defining a smoke outlet and a liquid cavity, wherein the liquid cavity is capable of storing a fluid to be vaporized, the smoke outlet communicates with environment outside of the shell; and a heating assembly engaged in the shell, receiving the liquid from the liquid cavity to heat and generate smoke, and comprising:

a chassis having an installation space communicating with the smoke outlet, and comprising:

a first wall having a top surface and bottom surface opposite to the top surface, the first wall being a bottom wall of the chassis, the first wall comprising a protrusion protruding beyond the top surface of the first wall and received in the installation space, the protrusion comprising an air entering plate protruding beyond the top surface; wherein an air vent is defined through the first wall and surrounded by the air entering plate, the air entering plate defines a plurality of air entering holes communicating with the installation space and the air vent; and a second wall connected and integrated with the first wall, the second wall being a side wall of the chassis, wherein the first wall and the second wall cooperatively define the installation space; and a heating component disposed in the installation space and configured to heat a fluid to generate smoke;

wherein the air vent has a length greater than that of each of the air entering holes along a direction from the bottom surface to the top surface.

17. The atomizer of claim 16, wherein a projection area of the air entering plate on the top surface is greater than a projection area of the air vent on the top surface; and the air entering plate is directly connected to the top surface, or the protrusion comprises a circumferential wall connected with the air entering plate and the top surface.

18. The atomizer of claim 16 wherein the heating assembly comprising a liquid guiding member connected with the heating component and heated by the heating component and a cover;

the cover is an integral structure defining a liquid tunnel and a smoke tunnel, the liquid tunnel communicates with the liquid cavity and extends to the liquid guiding member;

the liquid guiding member is configured to transport the fluid from the liquid tunnel to the installation space, and to heat the fluid to generate smoke in the installation space; and the smoke outlet communicates with the installation space via the smoke tunnel, such that the generated smoke is allowed to flow with the air to the smoke tunnel and further enter the smoke outlet.

19. The atomizer of claim 18, wherein a cross-section of the liquid tunnel has a non-circular configuration; and the liquid guiding member defines a groove in the upper surface, and the groove is interconnected with the liquid tunnel.

20. An electronic atomizing device, comprising an atomizer and a battery assembly connected together, wherein the atomizer comprises:

a shell defining a smoke outlet and a liquid cavity, wherein the liquid cavity is capable of storing a fluid to be vaporized, the smoke outlet communicates with environment outside of the shell; and a heating assembly engaged in the shell, receiving the liquid from the liquid cavity to heat and generate smoke, and comprising:

a chassis having an installation space communicating with the smoke outlet, and comprising:

a first wall having a top surface received in the installation space and a bottom surface opposite to the top surface and exposed outside, the first wall being a bottom wall of the chassis, the first wall defining an air vent extending through the bottom surface, an air entering plate being connected with the first wall and covering the air vent, the air entering plate defining at least one air entering hole communicating with the installation space and the air vent; and a second wall connected and integrated with the first wall, the second wall being a side wall of the chassis, wherein the first wall and the sidewall second wall cooperatively define the installation space; and a heating component disposed in the installation space and configured to heat the fluid from the liquid cavity to generate smoke;

wherein the at least one air vent has a length greater than that of the air entering hole along a direction from the bottom surface to the top surface.

* * * * *